US008359687B2

(12) United States Patent
Marlowe

(10) Patent No.: US 8,359,687 B2
(45) Date of Patent: Jan. 29, 2013

(54) INCUBATO/CRIB INFANT POSITIONING BLANKET

(76) Inventor: Ellen T. Marlowe, Owensboro, KY (US)

( * ) Notice: Subject to any disclaimer, the term of this patent is extended or adjusted under 35 U.S.C. 154(b) by 0 days.

(21) Appl. No.: 12/931,346

(22) Filed: Jan. 31, 2011

(65) Prior Publication Data

US 2012/0192353 A1 Aug. 2, 2012

(51) Int. Cl.

| | |
|---|---|
| ***B68G 5/00*** | (2006.01) |
| ***A47C 16/00*** | (2006.01) |
| *A47G 9/02* | (2006.01) |
| *A41B 9/00* | (2006.01) |
| *A41B 13/06* | (2006.01) |
| *A41D 11/00* | (2006.01) |
| *A61F 5/37* | (2006.01) |

(52) U.S. Cl. ..... 5/655; 5/494; 5/495; 2/73; 2/75; 2/69.5; 128/872; 128/873

(58) Field of Classification Search ..... 5/655, 494, 5/495, 492, 482, 498; 2/73, 75, 69.5, 114; 128/872, 873

See application file for complete search history.

(56) References Cited

U.S. PATENT DOCUMENTS

| | | | | |
|---|---|---|---|---|
| 1,403,873 | A * | 1/1922 | Scott | 5/494 |
| 3,521,309 | A * | 7/1970 | Evans | 5/494 |
| 5,621,931 | A * | 4/1997 | Hamilton | 5/493 |
| 6,381,785 | B1 * | 5/2002 | Mancera Browne et al. | 5/655 |
| 6,681,422 | B2 | 1/2004 | Landry | |
| 6,708,356 | B1 | 3/2004 | LaValle | |
| 6,817,048 | B1 | 11/2004 | LaRosa | |
| 7,337,481 | B2 | 3/2008 | Gilbert | |
| 7,603,732 | B2 | 10/2009 | Robles et al. | |
| 7,673,354 | B2 | 3/2010 | Fader | |
| 2005/0028278 | A1 * | 2/2005 | Landry | 5/494 |
| 2005/0210585 | A1 | 9/2005 | French | |
| 2008/0307577 | A1 | 12/2008 | Leckband | |
| 2009/0188046 | A1 | 7/2009 | Robles et al. | |
| 2010/0242173 | A1 | 9/2010 | Landry | |

* cited by examiner

*Primary Examiner* — Jonathan Liu
(74) *Attorney, Agent, or Firm* — Carrithers Law Office, PLLC; David W. Carrithers

(57) ABSTRACT

An adjustable incubator/crib infant positioning blanket for holding a premature baby securely in an incubator. The blanket includes a pouch to securely hold the baby with its head in an upright position on an inclined plane such as a raised mattress and the blanket is secured to the mattress by a strap. The pouch securely prevents the baby from rolling or sliding toward the bottom of the inclined mattress.

12 Claims, 5 Drawing Sheets

INCUBATO/CRIB INFANT POSITIONING BLANKET

TECHNICAL FIELD

The present invention relates to devices used to secure a baby in a bed and in particular to secure a premature baby in a selected position on a mattress in an incubator.

BACKGROUND OF THE INVENTION

New born and premature babies are often wrapped in a blanket or the covering in order to keep the enfant warm while sleeping.

Premature babies are often put on a mattress in an incubator which has the upper end elevated to hold the baby in a position where the baby's head is higher than the rest of the body. Unless otherwise restrained, the newborn babies roll down the incline or eventually wind up at the bottom due to squirming and the like, defeating the purpose of inclining the mattress to hold up the head. There are several types of blanket devices which are secured to a mattress in order to attach a sheet or blanket of a crib mattress and/or bumper pad to limit movement of the infant while sleeping. Some infants frequently change positions while sleeping so it is desirable to secure the baby in a desired sleeping position. Moreover, the risk of infant death due to Sudden infant Death Syndrome, "SIDS", is though to be reduced by placing babies on their backs to sleep.

Moreover, it is recommended to remove soft bedding from the baby's sleep area, keeping the baby's head and face uncovered during sleep and keeping blankets and other coverings away from a baby's mouth and nose by tucking the blanket in around the bottom of the crib mattress. However, merely tucking bedding around a crib mattress is not always sufficient to secure the bedding in view of the movement of active babies that kick and move around in bed.

Several devices have been utilized to secure the blanket to the mattress and hold the infant in a selected position upon the mattress.

U.S. Pat. No. 7,337,481 B2 by Gilbert for APPARATUS FOR SECURING BEDDING which issued on Mar. 4, 2008 teaches bedding including a pouch formed by two U-shaped semi-rigid members held together by magnets. The lower U-shaped member is secured to a blanket and the upper U-shaped member is attached to blanket portion which stretches across and covers the upper U-shaped member. The U-shaped members are removably held together by a plurality of magnets. The blanket and lower U-shaped member are secured to the mattress with two C-shaped frame members which are hooked around each side of the mattress. The inclusion of rigid U-shaped members and magnets and C-shaped hook members pose the problems of unnecessary bulk and problems associated with laundering and care of the bedding articles and storage of same.

U.S. Pat. No. 6,681,422 B2 for CRIB SAFETY SHEET/BLANKET by Landry which issued on Jan. 27, 2004 teaches a blanket portion sewn to the top central portion of a fitted sheet. The blanket is sewn down a centerline of the blanket portion, leaving the two halves of the blanket portion on either side of the stitching free to wrap around a baby. The blanket is fitted with hook and loop fasteners to secure the blanket around the baby. The fitted sheet is also secured around the mattress by a plurality of straps with hook and loop fasteners. If the Landry device was used on an inclined mattress, the baby could be left dangling from the stitched portion of the blanket and would be free to tip from side to side about the centrally stitched seam.

U.S. Pat. No. 7,603,732 B2 by Robles et al. for SLEEPING INFANT POSITIONING DEVICE which issued on Oct. 20, 2009 teaches bedding which is secured by straps which circumscribe the mattress. The bedding includes a waist panel secured to a bedding panel. The waist panel includes a belt securing an upper opening and two lower openings through which the baby's legs are passed while the upper opening contains the baby's lower abdomen. Robles includes several straps for holding the bedding to the mattress and for holding the baby within the waist panel requiring unnecessary time to secure the blanket to the mattress with conventional means. Further, Robles leaves the baby's legs exposed and unrestrained.

U.S. Patent Application Publication No. 20080307577 by Leckband for BABY CRIB SAFETY BLANKET published on Dec. 18, 2008 teaches a blanket including a pouch located in the middle of an extended length of blanket material. The extra blanket material on both sides of the pouch is rolled into a coils to help restrict movement of the baby within the bed such as rolling over. Leckband's blanket is not intended to be strapped to or otherwise connected to the mattress, and is therefore not secure on an inclined mattress.

SUMMARY OF THE INVENTION

The present invention provides a device for securing a baby in a selected position on a mattress or blanket panel including a strap for securing the device to the mattress. One end of the strap is fixed to a selected lateral edge of the mattress at the upper end of the mattress. The other end of the strap is fixed to the opposite lateral edge of the mattress at the upper end of the mattress. The strap connecting to the upper marginal edge of the blanket forms a loop. The device also includes a pouch fixed to a central position on a top surface of the mattress. The pouch comprises a blanket portion fixed to the mattress along a lower marginal edge and along both lateral marginal edges of the blanket portion. Also included in the device are means for fixing the pouch to the panel. The strap can be made adjustable by using an elastic material, hook and loop fasteners such as VELCRO, or a buckle.

It is an object of this present invention to provide a device which will secure a baby in a selected position on a mattress in an incubator.

It is another object of the present invention to hold a baby in position on a flat or inclined mattress using a washable or disposable pad made of paper, cotton, synthetic fibers and combinations thereof which are inexpensive and more comfortable to the baby as well as easy to apply and use.

It is another object of the present invention to utilize a portion of the blanket to partially wrap around and tuck under the mattress for more effective securing of the blanket with only a single strap which facilitates ease of use and minimizes the expense of production of same.

It is an object of the present invention to provide a device which will prevent a baby form slipping down an inclined mattress and maintain the baby's head in a raised position.

It is an object of the present invention to provide a device which will secure a baby in a selected position on a mattress wherein the device is a blanket with a pouch and a strap which can be wrapped around the mattress to secure the blanket in place.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
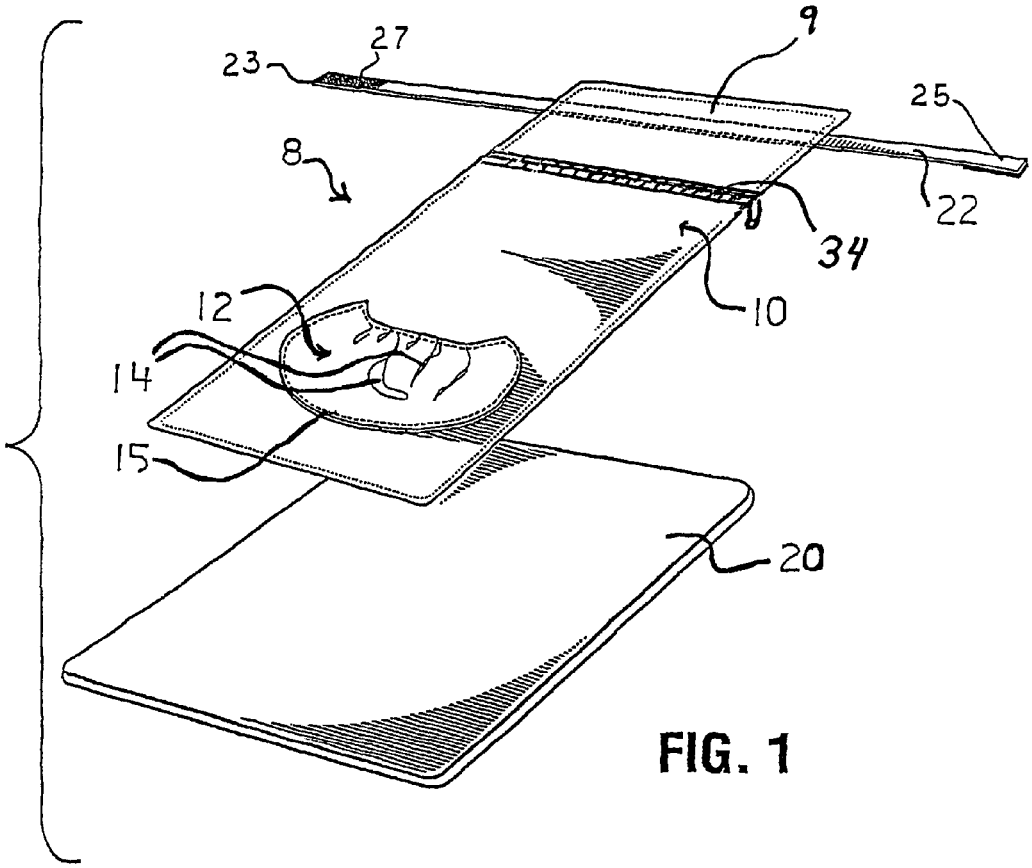
FIG. 1 is a perspective view of the blanket including a pouch.
Figure 2:
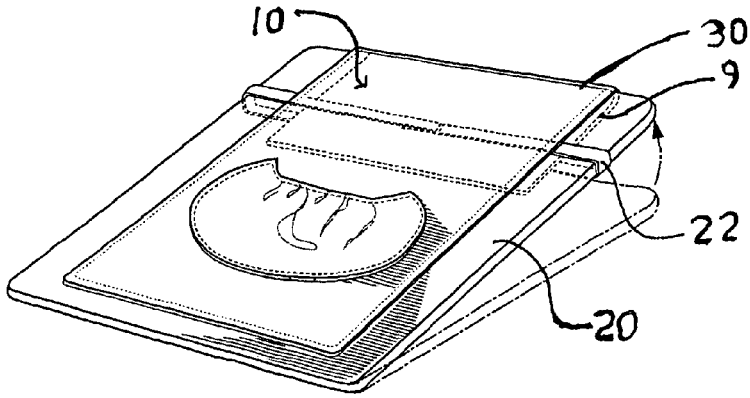
FIG. 2 is a perspective view of the blanket including a pouch showing the straps attached to the blanket and with the straps secured around a mattress.

In accordance with the present invention, there is provided a device which holds a baby in a selected position on a mattress. In particular, the device is used to hold a premature baby in a selected position on a blanket secured to a mattress in an incubator or crib. One example of a selected position is one wherein the mattress is inclined so that the baby's head is elevated above the body. Incubator blanket 8 is shown in FIGS. 1 and 2. Blanket 8 includes a pouch 12 secured to blanket panel 10 with stitching 15 at a lower marginal edge and along the lateral marginal edges of the pouch 12.

One embodiment of the present invention includes a removable or detachable pouch 12 having a flap 13 with gussets 14 which allow the pouch to blouse out and hold a greater volume than without gussets 14. Elastic band 26 (shown in FIG. 3) is sewn into the upper marginal edge of pouch 12 to help secure a baby's lower torso within the pouch 12. Other means for affixing the flap 13 of the pouch 12 to the blanket 8 include buttons, zippers, hook and eye fasteners, straps, ties and the like, and combinations thereof fastened to the mattress by holding means such as hook and loop fasteners "VELCRO", a buckle, zip ties, or other strap securing means. As best shown in FIG. 4, the pouch 12 is removably secured to the top surface of the blanket 8 by hook and loop fasteners 15, 16, and 17 such as VELCRO; however, the pouch could be sewn or snapped in place as well.

As shown in the drawings, the blanket 8 includes a single strap 22, as shown best in FIG. 2, which is placed around the mattress 20 with an upper end portion 9 of blanket 8 tucking under mattress 20. The remaining portion of the blanket 8 is folded down over the top surface of mattress 20. The strap 22 holds the blanket 8 in a selected fixed position upon mattress 20 as shown in FIG. 2. FIG. 1 shows the mattress 20 inclined to a position wherein a baby held within pouch 12 is held in a position wherein the major axis of the baby's body is centered with the inclined mattress and where the baby's head is higher than the baby's body. Without a pouch 12, the baby tends to slide or roll down to an undesirable position wherein the head is not in the raised position.

Figure 3:
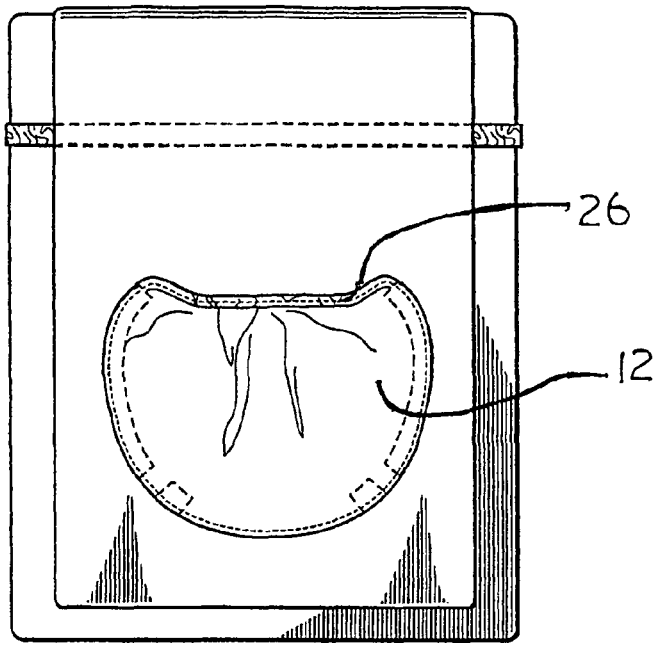
FIG. 3 is top of the blanket with the pouch secured to a mattress.
Figure 4:
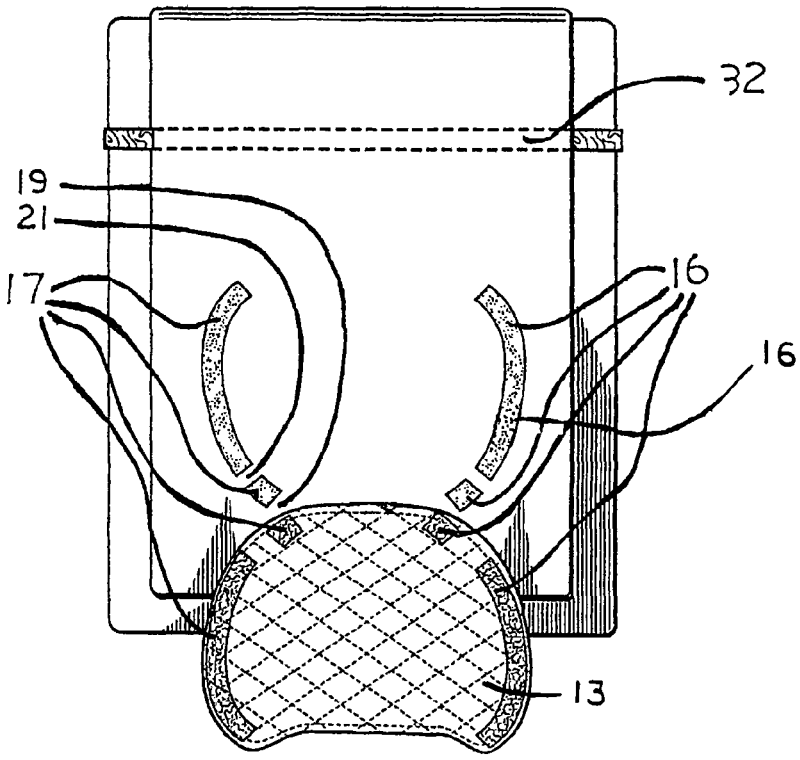
FIG. 4 is top view of the blanket with the pouch opened for cleaning.

FIGS. 1-4 show the blanket being applied to the mattress wherein strap 22 is secured to the mattress by wrapping it around the upper end of the mattress 20. As shown in FIG. 3, the wrap around portion 9 of blanket panel 10 is bounded on one end by strap 22 and on an opposite end by marginal area 30. Mattress 20 actually rests on top of blanket portion 9 folded in under the mattress to help secure the blanket panel 10 in a selected position. The strap 22 of the preferred embodiment shown in FIGS. 1-2, has two free distal ends 23, 25 with hook and loop fasteners 27, or tie means. The combination of blanket portion 9 being held firm under the mattress by friction along with strap 22 holding firm around the mattress is seen as a secure fixing of blanket 8 to mattress 20. However, the surface of blanket portion 9 which contacts the bottom of mattress 20 may be partially or totally covered with an elastomer or any material which would tend to cling to mattress 22 to further enhance the securing of blanket 8 to mattress 20. Further, the entire surface of blanket panel 10 which contacts the mattress 20 may be partially or totally covered with an elastomeric type material. Because portion 9 of blanket 8 is disposed below the bottom surface of the mattress while in use, the panel 30 portion may include a zipper 34 or hook and loop material 38 which allows portion 9 to be separated from blanket panel 10 of blanket 8, thus allowing all but portion 9 of blanket 8 to be laundered separately. This would extend the life of blanket portion 9 and any elastomeric covering which may be included.

Figure 7:
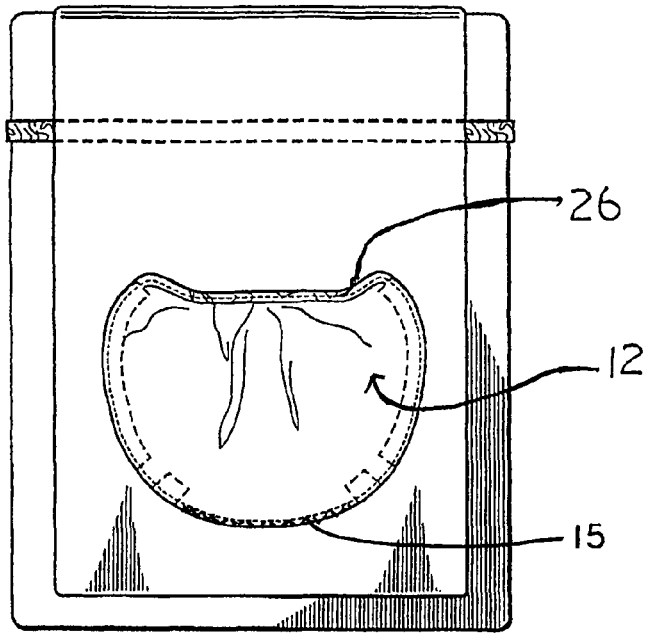
FIG. 7 is a top view showing the detachable flap with hook and loop fasteners on the lateral edges and stitching holding the bottom of the flap to the blanket.

A further embodiment, shown in FIGS. 3 and 4, includes strap 32 which is an elastic loop rather than a two part strap 22 with hook and loop fasteners. Also, as shown in FIG. 7, pouch 12 is secured to the blanket panel 10 with both stitching 15 at a lower marginal edge and by hook and loop fasteners 16 and 17 at both lateral marginal edges. Hook and loop fasteners 16 and 17 allow pouch 12 to be opened for easy cleaning and easy positioning and removal of the baby. Other embodiments have buttons and eyelets, draw string, zippers, hook and loop fasteners, straps, or ties instead of hook and loop fasteners to secure the lateral marginal edges of pouch 12.

As shown in FIG. 4, the pouch includes spaced apart strips of hook and loop fasteners 16, 17 rather than a continuous strip of hook and loop fasteners in order to provide a spacing means defining a channel, duct, or conduit 19, 21 for insertion of a lead wire, tubing, or other medical support leads (not shown) which must be connected to the babies feet, legs, abdomen, or chest held within the pouch 12 so as not to be accessible to the babies arms which remain outside of the pouch.

Figure 5:
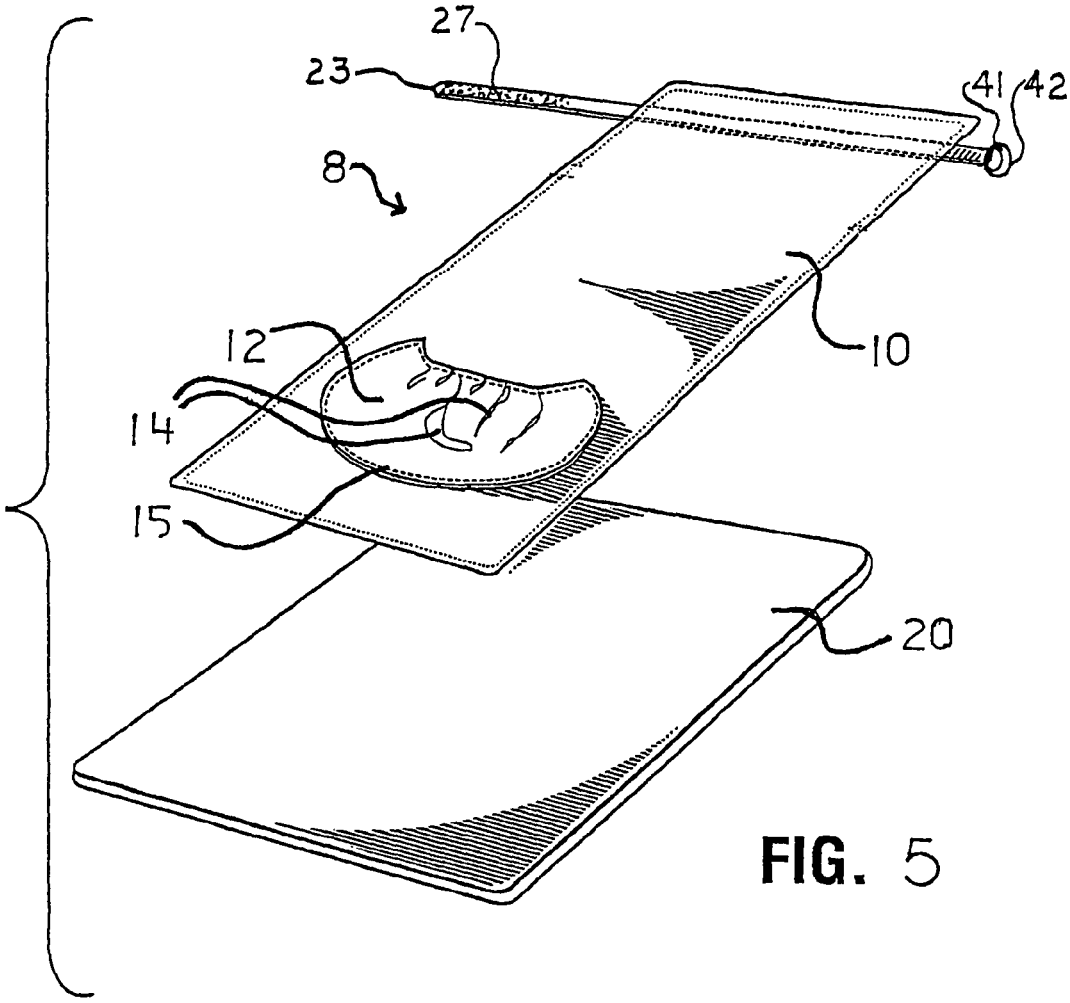
FIG. 5 is a top view of the blanket and pouch with the mattress.
Figure 6:
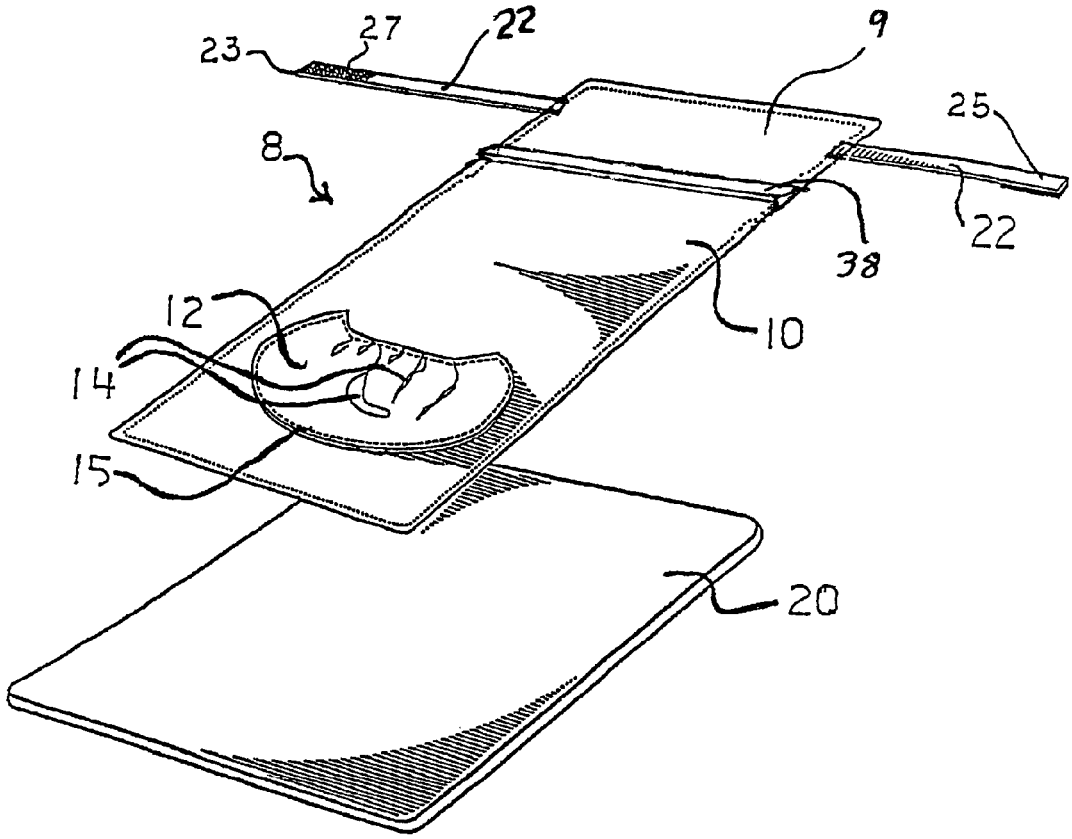
FIG. 6 is a top view of the blanket with a two part strap 22 and hook and a loop fastener for connecting the blanket to a blanket panel.

As shown in FIG. 5, a distal end of the strap 22 may include one or even two loops 41, 42 for insertion of the strap 22, whereby the free end of the strap 22 can be threaded between the loops 41,42 and tightened prior to connecting to the other distal end of the strap 22 by hook and loop fasteners or the like to provide a second means for holding the strap to the mattress or to provide additional tightening means in addition to the hook and loop, button and eyelet, snaps, or buckle.

Another embodiment of the invention provides pouch 12 being attached to blanket panel 10 with stitching 24 around both lateral edges and the bottom edge of pouch 12 with elastic 26 sewn into the upper marginal edge.

Figure 8:
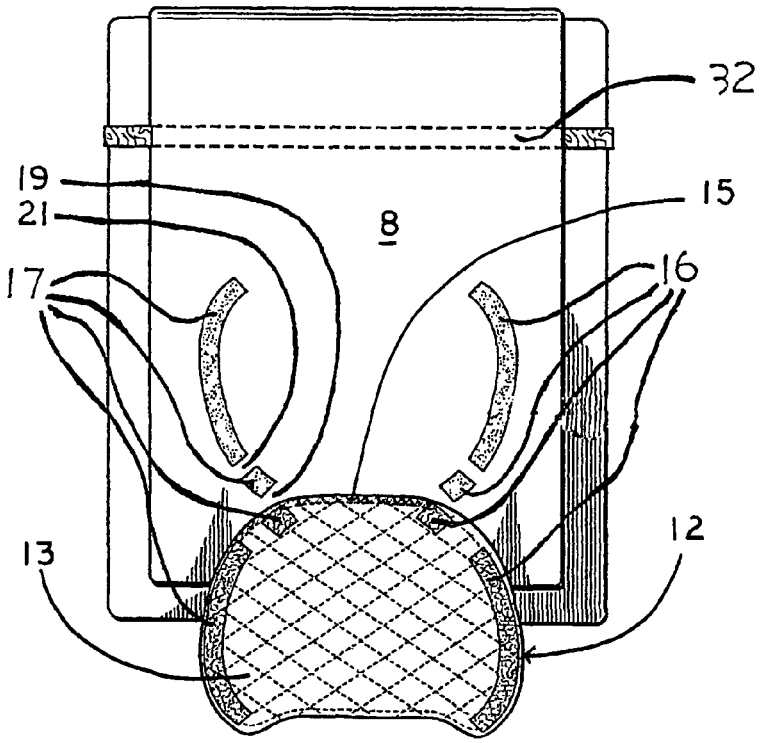
FIG. 8 is a top view showing the detached flap with hook and loop fasteners on the lateral edges and stitching holding the bottom of the flap to the blanket.

Another embodiment of the invention as shown in FIGS. 7 and 8 provide the flap 13 of the pouch 12 being attached to the mattress or blanket panel 10 with stitching 15 around the bottom edge and having hook and loop fasteners 16, and 17 around both the lateral edges at selected positions spaced apart including gaps there between and having elastic 26 sewn into the upper marginal edge.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A device for securing a baby in a selected position on a mattress or panel consisting of:

a blanket, said blanket having a strap for securing said device to said mattress, one end of said strap fixed to one lateral edge of said blanket at the upper end of said blanket, and the other end of said strap fixed to the opposite lateral edge of said blanket at the upper end of said blanket, said strap and said upper end of said blanket forming a loop around said mattress; and a detachable flap positioned below said strap and affixed to a central position on a top surface of said blanket, wherein said flap forms a pouch with said blanket, said detachable flap affixed to said blanket along both lateral marginal edges of said detachable flap by spaced apart strips of hook and loop fasteners, said spaced apart strips of hook and loop fasteners providing a channel near said lower marginal edge for insertion of a lead wire, tubing, or other medical support leads for providing to a baby's feet, legs, abdomen, or chest.

2. The device defined in claim 1 wherein an upper marginal edge of said pouch includes elastic material for urging the opening of said pouch to a closed position.

3. The device defined in claim 1 wherein said pouch contains expandable gussets for providing more room in said pouch.

4. The device defined in claim 1 wherein said strap comprises two strap portions with free ends terminated by elements selected from the group consisting of hook and loop fasteners, ties, and hook and eye fasteners.

5. The device defined in claim 1 wherein said strap comprises elastic material.

6. The device defined in claim 1 wherein a surface of said blanket which is in contact with said mattress is provided with an elastomeric coating for resisting the sliding of said blanket along said surface of said mattress.

7. The device defined in claim 1 wherein said blanket comprises two panel portions, a first panel portion consisting of a portion of said blanket which contacts the upper surface of said mattress, and a second panel portion consisting of a portion of said blanket folding under said mattress, said two panel portions being detachably connected along their respective marginal edges by elements selected from the group consisting of hook and loop fasteners, a zipper, or combinations thereof, said detachable connection enabling the laundering of one portion of said device without the laundering of another portion of said device.

8. A device for securing a baby in a selected position in an incubator consisting of:

a mattress, said mattress being inclined for the purpose of elevating the head of a baby above the baby's body, a blanket, said blanket having a strap for securing said device to said mattress, one end of said strap fixed to one lateral edge of said blanket at the upper end of said blanket, and the other end of said strap fixed to the opposite lateral edge of said blanket at the upper end of said blanket, said strap and said upper end of said blanket forming a loop; and a flap fixed to a central position on a top surface of said blanket, said flap forming a pouch with said blanket and fixed to said blanket along a lower marginal edge and along both lateral marginal edges of said flap by spaced apart strips of hook and loop fasteners, said spaced apart strips of hook and loop fasteners providing a channel near said lower marginal edge for insertion of a lead wire, tubing, or other medical support leads which are attached to a baby's feet, legs, abdomen, or chest.

9. The device defined in claim 8 wherein an upper marginal edge of said pouch includes elastic material for urging the opening of said pouch to a closed position.

10. The device defined in claim 8 wherein said pouch contains expandable gussets for providing more room in said pouch.

11. The device defined in claim 8 wherein said strap comprises two strap portions with free ends terminated by elements selected from the group consisting of hook and loop fasteners, ties, and hook and eye fasteners.

12. The device defined in claim 8 wherein said strap comprises elastic material.

* * * * *